US008753133B1

(12) United States Patent
Errato, Jr. et al.

(10) Patent No.: US 8,753,133 B1
(45) Date of Patent: Jun. 17, 2014

(54) ELECTRICAL POWER CONNECTOR WITH IMPROVED GROUND CONTINUITY AND METHOD FOR MANUFACTURING SAME

(76) Inventors: Andrew Errato, Jr., Milford, CT (US); Sean Ylagan, Fair Haven, NJ (US); Barry Greenberg, Manalapan, NJ (US)

( * ) Notice: Subject to any disclaimer, the term of this patent is extended or adjusted under 35 U.S.C. 154(b) by 0 days.

(21) Appl. No.: 13/592,039

(22) Filed: Aug. 22, 2012

Related U.S. Application Data

(60) Provisional application No. 61/580,050, filed on Dec. 23, 2011.

(51) Int. Cl.
*H01R 13/648* (2006.01)

(52) U.S. Cl.
USPC ..... 439/108; 439/95; 439/607.12

(58) Field of Classification Search
USPC ..... 439/108, 95, 607.12
See application file for complete search history.

(56) References Cited

U.S. PATENT DOCUMENTS

| | | | | |
|---|---|---|---|---|
| 3,980,368 | A * | 9/1976 | Fremont | 439/94 |
| 6,918,788 | B2 * | 7/2005 | Cavanaugh | 439/587 |
| 2002/0192993 | A1 * | 12/2002 | Decicco | 439/271 |
| 2003/0143892 | A1 * | 7/2003 | Raypole et al. | 439/578 |
| 2004/0087198 | A1 * | 5/2004 | Decicco | 439/271 |

* cited by examiner

*Primary Examiner* — Gary Paumen
(74) *Attorney, Agent, or Firm* — Steven McHugh

(57) ABSTRACT

An electrical connector and a method for assembling the electrical connector is provided, wherein the electrical connector includes a connector shell defining a connector shell cavity and having a connector nose end and a connector base end, wherein the connector shell includes a connector shell internal threaded portion proximate the connector base end, a contact insert having a power contact carrier, a ground contact carrier and a ground plane, wherein the ground contact carrier is conductively connected to the ground plane and a bonding nut having a bonding nut threaded portion, wherein the contact insert and bonding nut is contained within the connector shell cavity to be proximate the connector base end, such that the bonding nut threaded portion engages the connector shell internal threaded portion to contact the ground plane.

20 Claims, 21 Drawing Sheets

SECTION A-A

SECTION B–B

SECTION C–C

| Cable Type | Minimum Bending Radius as a Multiple of Overall Cable Diameter |
|---|---|
| Single or Multiple Conductor Cables without Metallic Shielding | 8 times the overall cable diameter |
| Single Conductor Cables with Shielding | 12 times the overall cable diameter |
| Multiple Conductor Cables with Individually Shielded Conductors | 12 times the individual cable diameter or 7 times the overall cable diameter -- whichever is greater |
| Portable (Mining) Cables | 6 times for cables rated 5000 volts or less, 8 times for cables rated over 5000 volt |
| Fiber Optic Cables | 10 times overall diameter for multimode cables, 20 times overall diameter for singlemode cables |
| Interlocked Armor or Corrugated Sheath (Type MC) Cables | 7 times overall cable diameter |

*FIG. 12*

ELECTRICAL POWER CONNECTOR WITH IMPROVED GROUND CONTINUITY AND METHOD FOR MANUFACTURING SAME

RELATED APPLICATIONS

This application is related to U.S. Non-Provisional patent application Ser. No. 13/590,918 and claims benefit of the filing date of U.S. Provisional Patent Application Ser. No. 61/580,050, filed Dec. 23, 2011, the contents of both of which are incorporated by reference herein in their entirety.

FIELD OF THE INVENTION

The present invention relates generally to an electrical power connector and more particularly to a heavy duty power connector having a higher reliability ground and that is more ergonomic and user friendly than traditional heavy duty power connectors.

BACKGROUND OF THE INVENTION

Class L electrical power connectors are well known in the art and are standard power connectors that have been in use for at least 50 years. These types of connectors are designed to Military Specification MIL-DTL-22992 to be suitable for heavy duty use in industrial and military applications. Typically, Class L connectors are configured with different shell sizes ranging from 28 to 52 and they are configured to operate with conductor sizes that range from size 6 to 4/0 AWG and are used to operate with electrical currents ranging from 40 to 200 amperes. Because these connectors are for heavy duty uses and large power applications, it is important, from a safety and operational perspective, that the connector has a suitable strain relief and that the shell maintains continuity to the ground pin(s) (this is also a requirement of the MIL-SPEC). In current Class L connectors this is accomplished by using an aluminum back shell and a wire mesh Kellems grip. The continuity is achieved by bonding the ground pin(s) together in the front shell of the connector via a metal ring. The back shell is screwed and tightened to the front shell and the metal of the back shell bonds to a metal ground ring. This creates continuity between the entire connector body and the ground pin(s). One view of a prior art Class L connector is shown in FIG. 1.

Unfortunately, the aluminum back shell and Kellems grip used with current Class L connectors have several undesirable characteristics. First, because the metal body of the connector is exposed to the environment, these connectors can freeze making handling difficult. Second, because the aluminum back shell used to create ground continuity is large, the connectors are large, bulky and non-ergonomic. Third, because these connectors are used in heavy duty applications and the Kellems grip is exposed to the environment, the Kellems grip tends to fray overtime causing individual wires of the wire mesh to stick out of the grip. Thus, when a user grabs the grip, the frayed wires tend to cut the hand of the user.

SUMMARY OF THE INVENTION

An electrical connector is provided and includes a connector shell defining a connector shell cavity and having a connector nose end and a connector base end, wherein the connector shell includes a connector shell internal threaded portion proximate the connector base end. The electrical connector further includes a contact insert having a power contact carrier, a ground contact carrier and a ground plane, wherein the ground contact carrier is conductively connected to the ground plane. Additionally, a bonding nut is included and has a bonding nut threaded portion, wherein the contact insert and bonding nut is contained within the connector shell cavity to be proximate the connector base end, such that the bonding nut threaded portion engages the connector shell internal threaded portion to contact the ground plane.

An electrical connector assembly is provided and includes a contact insert, a connector shell and a bonding nut. The contact insert includes an insert front, an insert rear, a ground contact carrier, a power contact carrier and a ground plane, wherein the power contact carrier and ground contact carrier are conductively communicated with the insert front and the insert rear, and where the ground contact carrier is conductively connected to the ground plane. The insert front is configured to associate with a compatible electrical interface and the insert rear is configured to associate with a conductor of a cable. Additionally, the connector shell is configured to contain at least a portion of the contact insert and includes a connector nose end and a connector base end, and wherein when the contact insert is contained within the connector shell, the insert rear is located relative to the connector base end such that when the conductor of the cable is associated with the insert rear, the conductor is at least partially located within the connector shell. When the contact insert is contained within the connector shell, the bonding nut is securely associated with the connector shell such that the connector shell, the ground plane, the ground contact carrier and the bonding nut are electrically and conductively connected.

A method for assembling an electrical connector is provided, wherein the electrical connector includes a connector shell defining a connector shell cavity and having a connector nose end, a connector base end and a connector shell internal threaded portion proximate the connector base end. The electrical connector includes a contact insert having a contact rear, a power contact carrier, a ground contact carrier and a ground plane, and a bonding nut having a bonding nut threaded portion. The method includes inserting the contact connector into the connector shell cavity such that the contact rear is proximate the connector base end, associating the bonding nut with the connector shell cavity such that the connector shell internal threaded portion and the bonding nut threaded portion engage each other whereby the bonding nut compresses the ground plane, connecting a power conductor of a cable with the power contact carrier and a ground conductor of the cable with the ground contact carrier and associating a pre-mold material with the connector base end of the electrical connector to cover a portion of the contact insert, a portion of the connector base end and a portion of the cable.

BRIEF DESCRIPTION OF THE DRAWINGS

The foregoing and other features and advantages of the present invention will be more fully understood from the following detailed description of illustrative embodiments, taken in conjunction with the accompanying drawings in which like elements are numbered alike in the several Figures:

FIG. 12 is a table illustrating a simplified version of actual industry MBR recommendations for different cable types.

DETAILED DESCRIPTION OF THE INVENTION

Figure 1A:
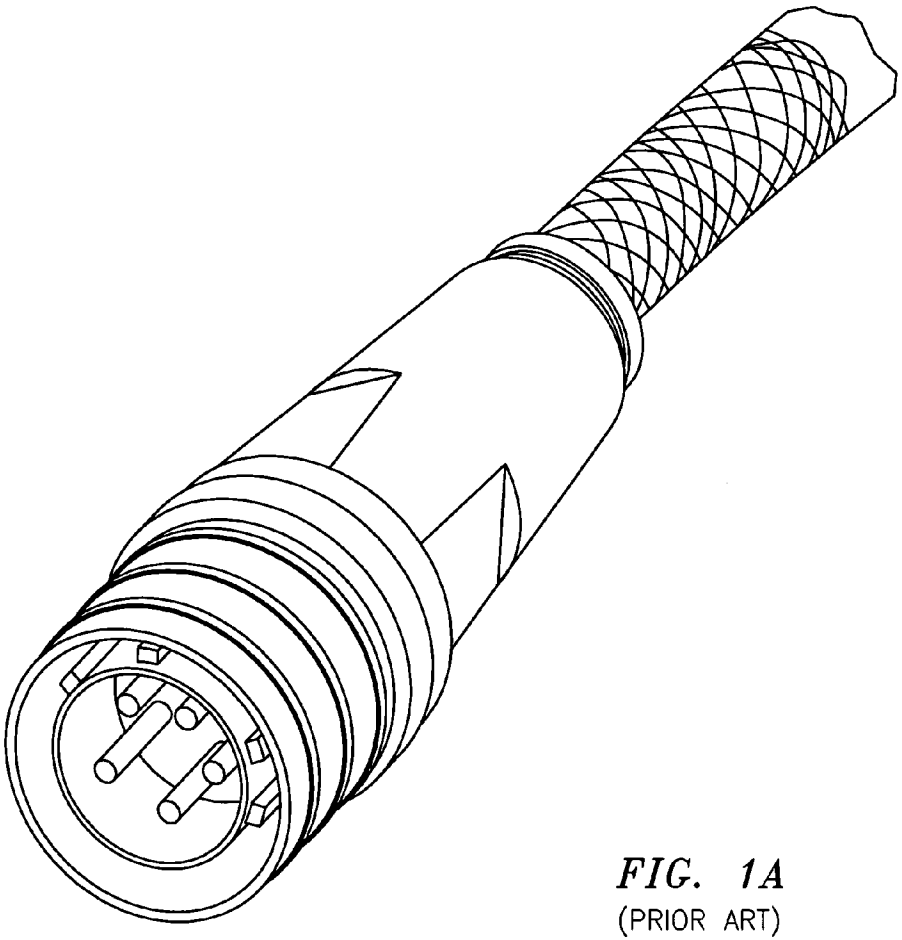
FIG. 1A (PRIOR ART)
FIG. 1A is a perspective view of a Class L connector and cable assembly showing a Kellems Grip, in accordance with the prior art.
Figure 1B:
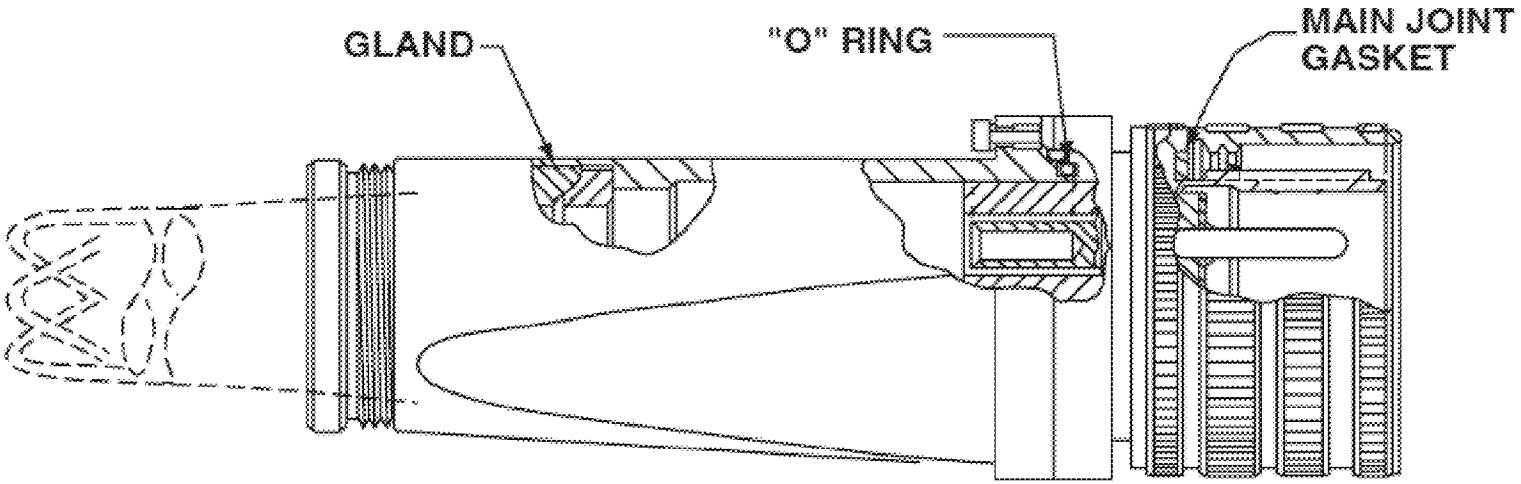
FIG. 1B PRIOR ART
FIG. 1B is a side sectional view of a connector and a Kellems Grip, in accordance with the prior art.

Referring to FIG. 1B, it should be appreciated that in addition to addressing the disadvantages of the prior art as discussed hereinbefore, the present invention also provides for a more streamlined packaging by eliminating the need of the large and bulky backshell, as well as other components like the gland, the gland seals, the main joint gasket and the O-Rings.

Figure 2A:
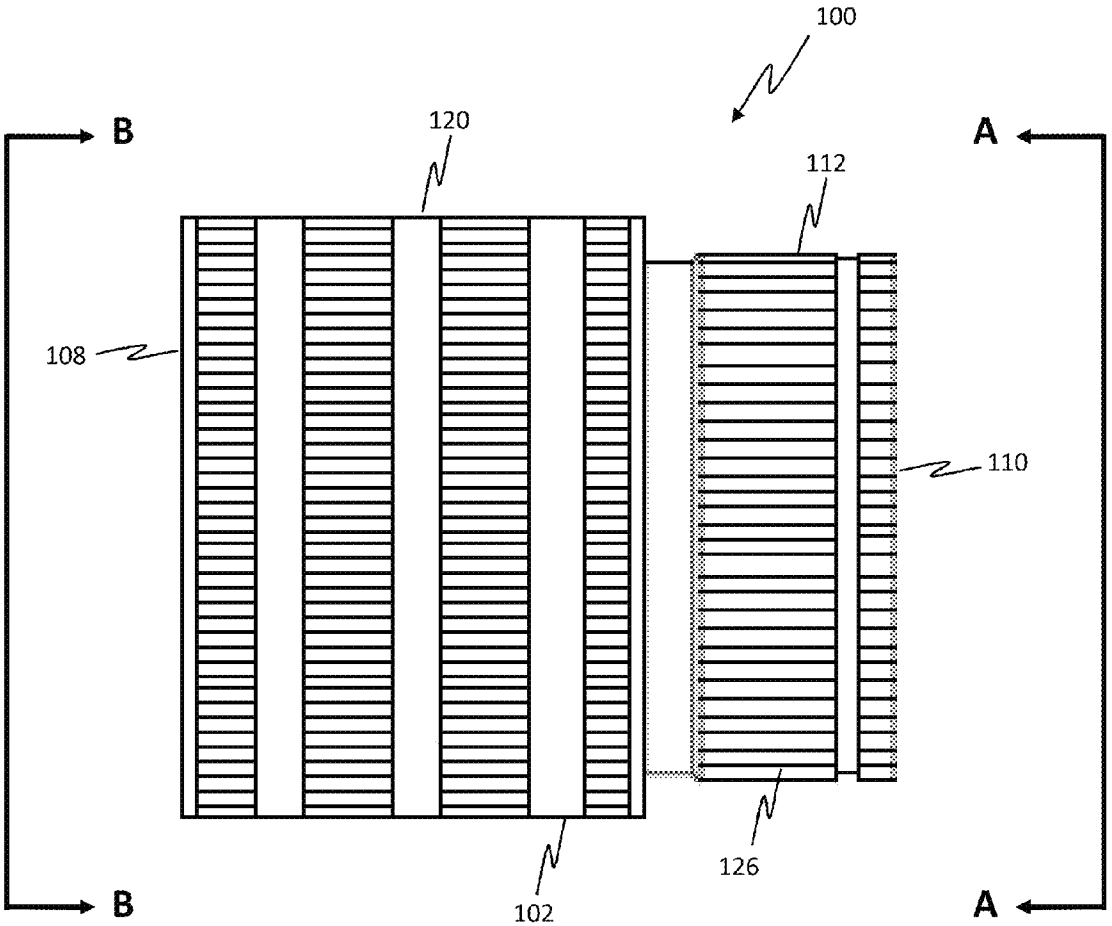
FIG. 2A is a side view of a male version Class L connector shell, in accordance with one embodiment of the present invention.
Figure 2B:
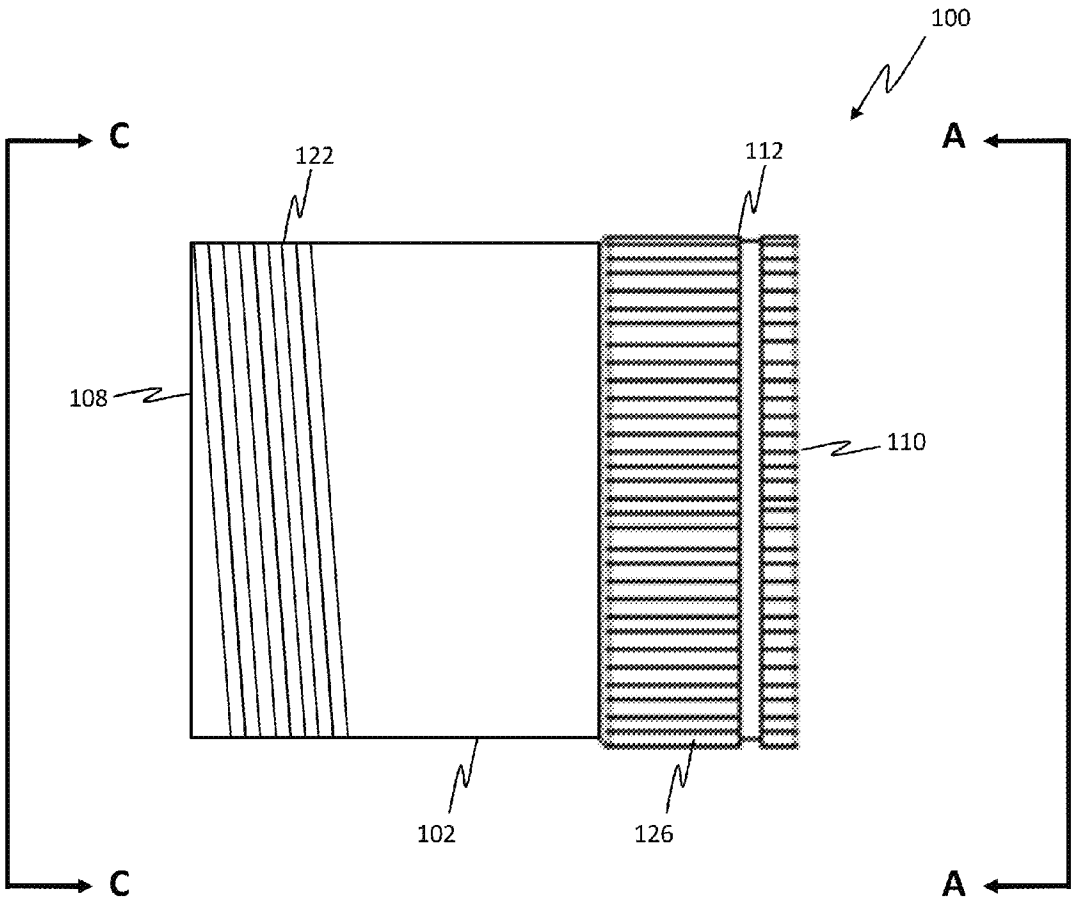
FIG. 2B is a side view of a female version Class L connector shell, in accordance with one embodiment of the present invention.
Figure 3A:
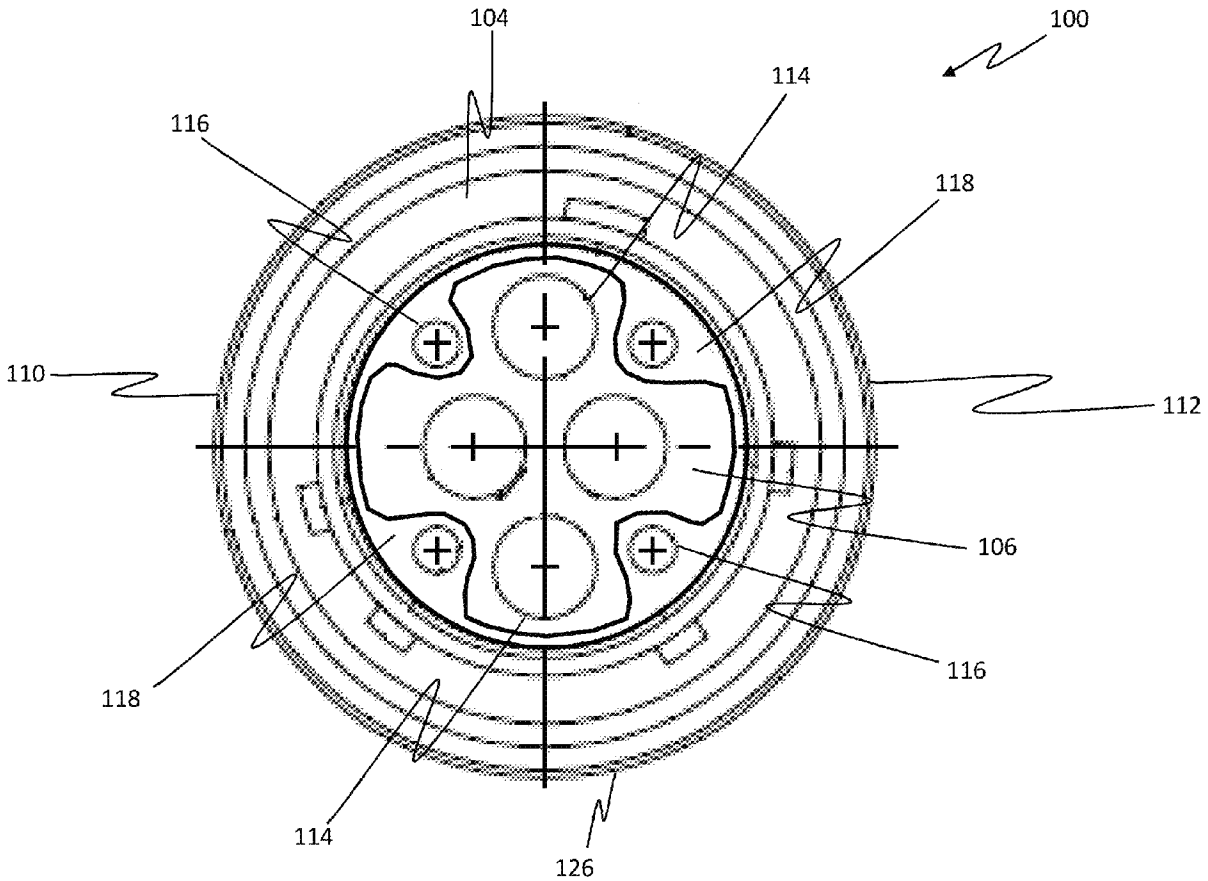
FIG. 3A is a rear end view of the Class L connector shell of FIGS. 2A and 2B, showing the plug/socket shell and contact insert.
Figure 3B:
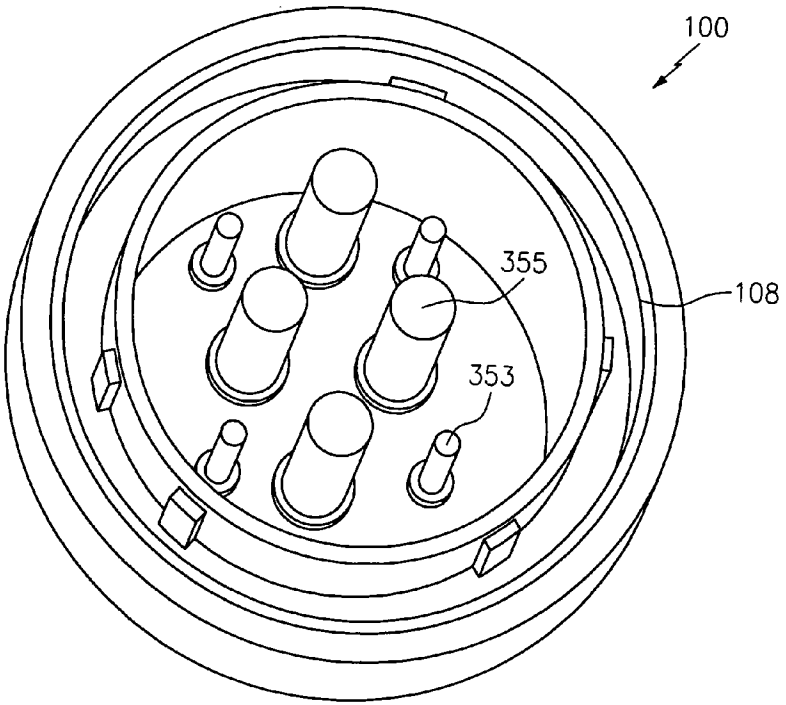
FIG. 3B is a front end view of the Class L connector shell of FIG. 2A, showing the male plugs of the connector.
Figure 3C:
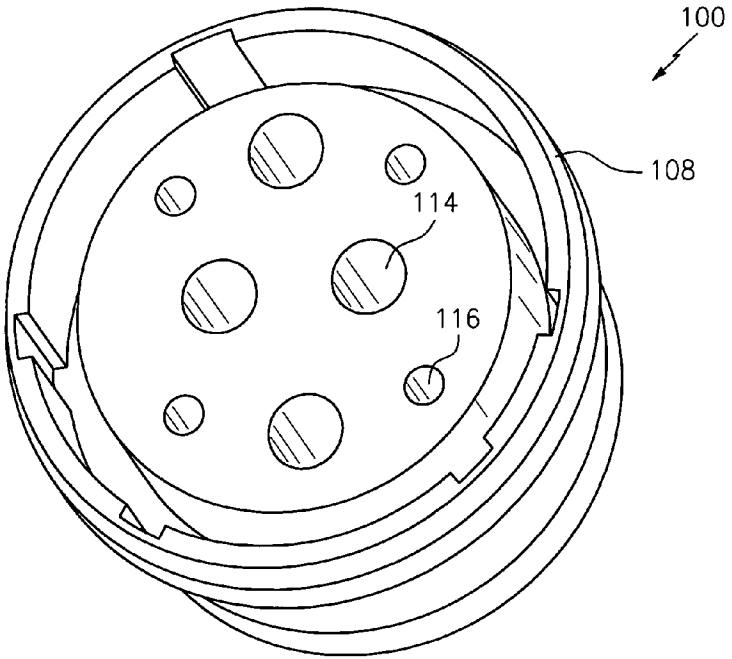
FIG. 3C is a front view of the Class L connector shell of FIG. 2B, showing the female sockets of the connector.

In accordance with the present invention, referring to FIG. 2A, FIG. 2B and FIG. 3A, an electrical connector 100 that conforms to MIL-DTL-22992 specifications is disclosed and includes a connector shell 102 defining a connector shell cavity 104 for containing a contact insert 106. The connector shell 102 includes a nose end 108 and a base end 110, wherein the nose end 108 is configured to connectively couple with a compatible connector. The connector shell cavity 104 includes a plug/socket shell portion 112 which contains at least a portion of the contact insert 106. The contact insert 106 includes at least one power contact carrier 114, at least one ground contact carrier 116 and a ground plane 118, wherein the ground plane 118 is conductively connected to the at least one ground contact carrier 116. It should be appreciated that the nose end 108 may include a coupling ring 120 (see FIG. 2A) for coupling with a compatible female connector or the nose end 108 may include a threaded surface 122 (see FIG. 2B) for coupling with a compatible male connector. It should be appreciated that the male version of the electrical connector 100 includes a contact insert 106 that is configured as a male (See FIG. 3B) and the female version of the electrical connector 100 includes a contact insert 106 that is configured as a female (See FIG. 3C), as described hereinafter.

Figure 4:
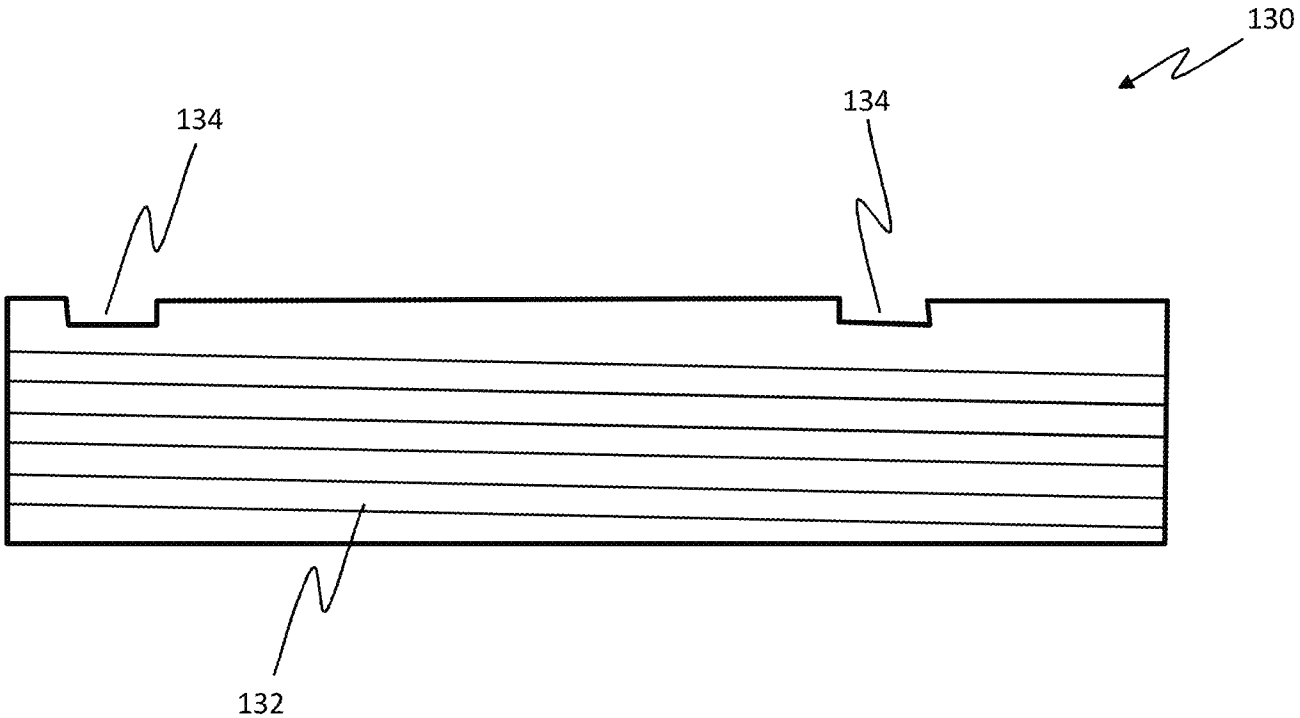
FIG. 4 is side view of the bonding nut of the Class L connector shell of FIG. 2A and FIG. 2B.
Figure 5:
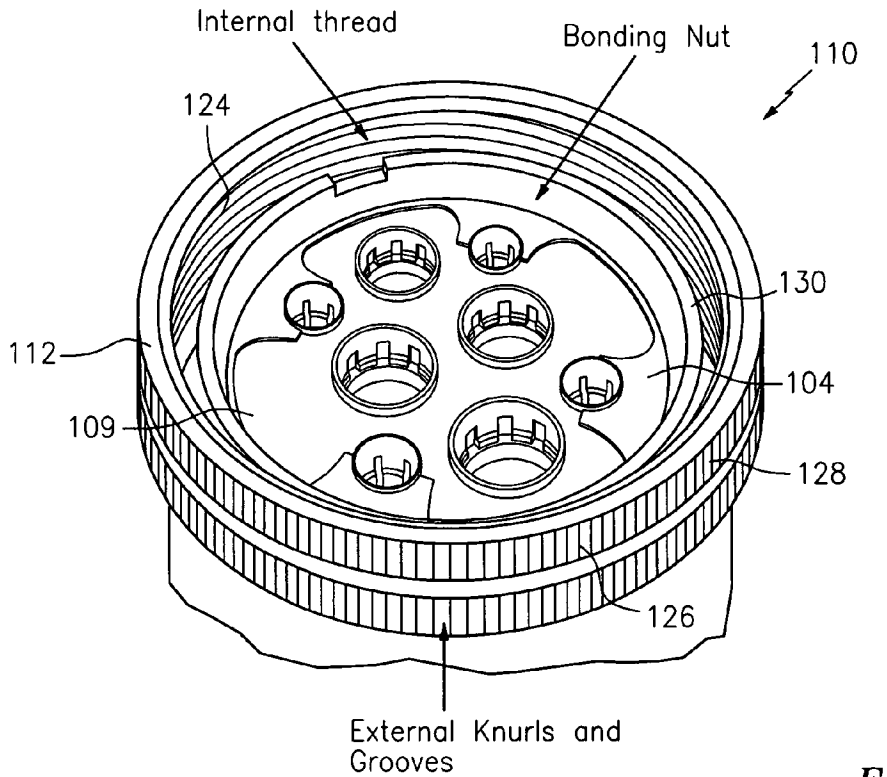
FIG. 5 is a rear side perspective isometric view of the plug/socket shell and contact insert of the Class L connector of FIG. 2A and FIG. 2B.

Referring again to FIG. 3A as well as FIG. 4 and FIG. 5, the connector shell 102 proximate the plug/socket shell portion 112 includes a plug/socket shell threaded inner surface 124 and an outer surface 126, where the outer surface 126 of the connector shell 102 may include a plurality of knurls/grooves 128. It should be appreciated that electrical connector 100 may include a pre-mold material as discussed hereinafter and that the knurls/grooves 128 may be configured to extend (fully or partially) along the circumference of the outer surface 126 to prevent/limit longitudinal movement of the pre-mold material and/or the knurls/grooves 128 may be configured to extend (fully or partially) along the length of the outer surface 126 to prevent/limit rotational movement of the pre-mold material. One example of such a configuration would include a crisscross pattern of knurls/grooves 128. Furthermore, the electrical connector 100 includes a bonding nut 130, where the bonding nut 130 includes a bonding nut threaded surface 132 and at least one adjustment notch 134. It should be appreciated that the bonding nut 130 is sized and shaped to be located within the connector shell cavity 104 proximate the plug/socket shell portion 112, wherein when the bonding nut 130 is located within the plug/socket shell portion 112, the bonding nut threaded surface 132 threadingly and securingly interacts with the plug/socket shell threaded inner surface 124.

It should be appreciated that the at least one adjustment notch 134 allows a tool to be used to install and remove the bonding nut 130 from the shell cavity 104. When being installed, a portion of the adjustment tool fits into the at least one adjustment notch 134 to engage the bonding nut 130 and to rotate the bonding nut 130 in a first direction to be threadingly and tightly screwed into the shell cavity 104 such that the bonding nut 130 compresses the ground plane 118. When being removed, the tool is used to rotate the bonding nut 130 in a second direction. It should be appreciated that the connector shell 102, the ground plane 118 and the bonding nut 130 are preferably constructed from a conductive material, such as a conductive metallic material. Accordingly, when the bonding nut 130 is tightly associated with the connector shell 102 such that the bonding nut 130 compresses the ground plane 118, the above arrangement advantageously provides ground continuity between the connector shell 102, the ground plane 118, the bonding nut 130 and the at least one ground contact carrier 116. It should be appreciated that the bonding nut 130 may also be installed without a tool.

Figure 6A:
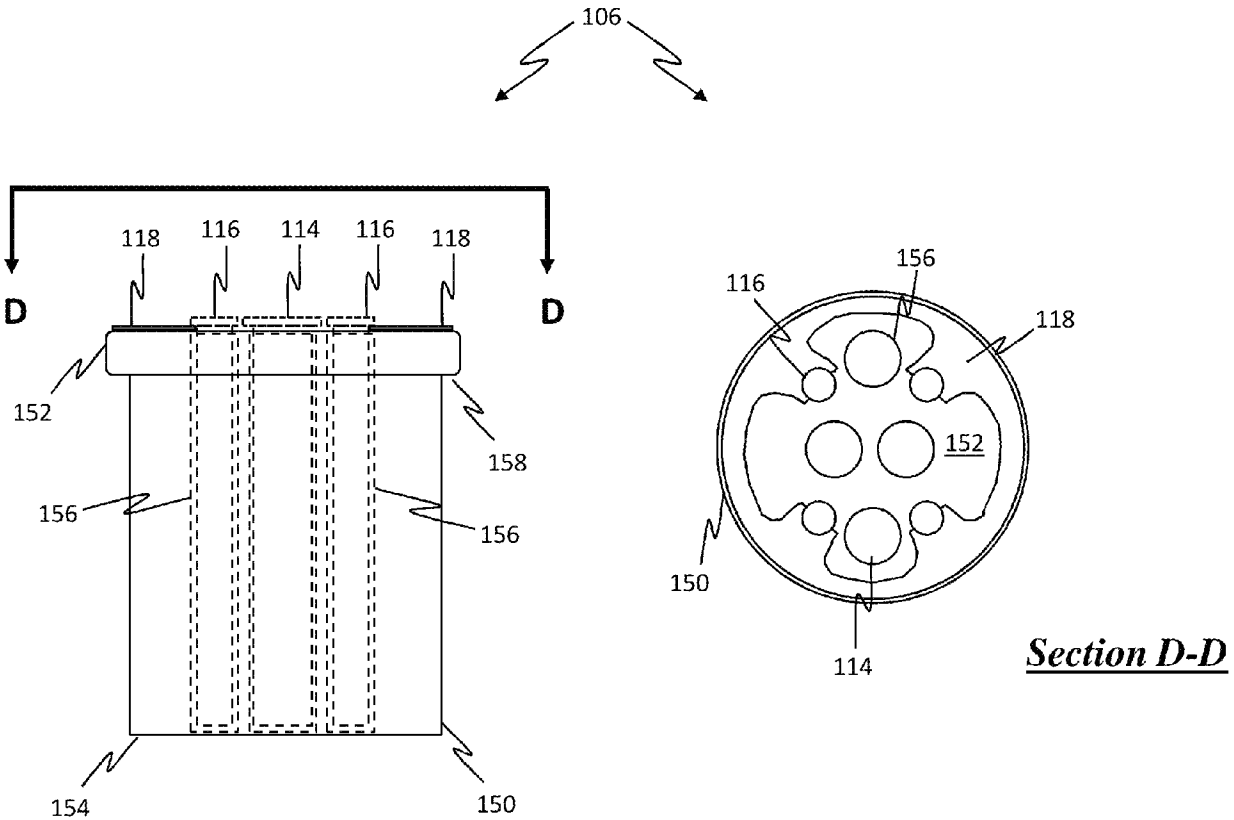
FIG. 6A is a side and top down view of a female contact insert for the Class L connector of FIG. 2B, in accordance with one embodiment of the present invention.
Figure 6B:
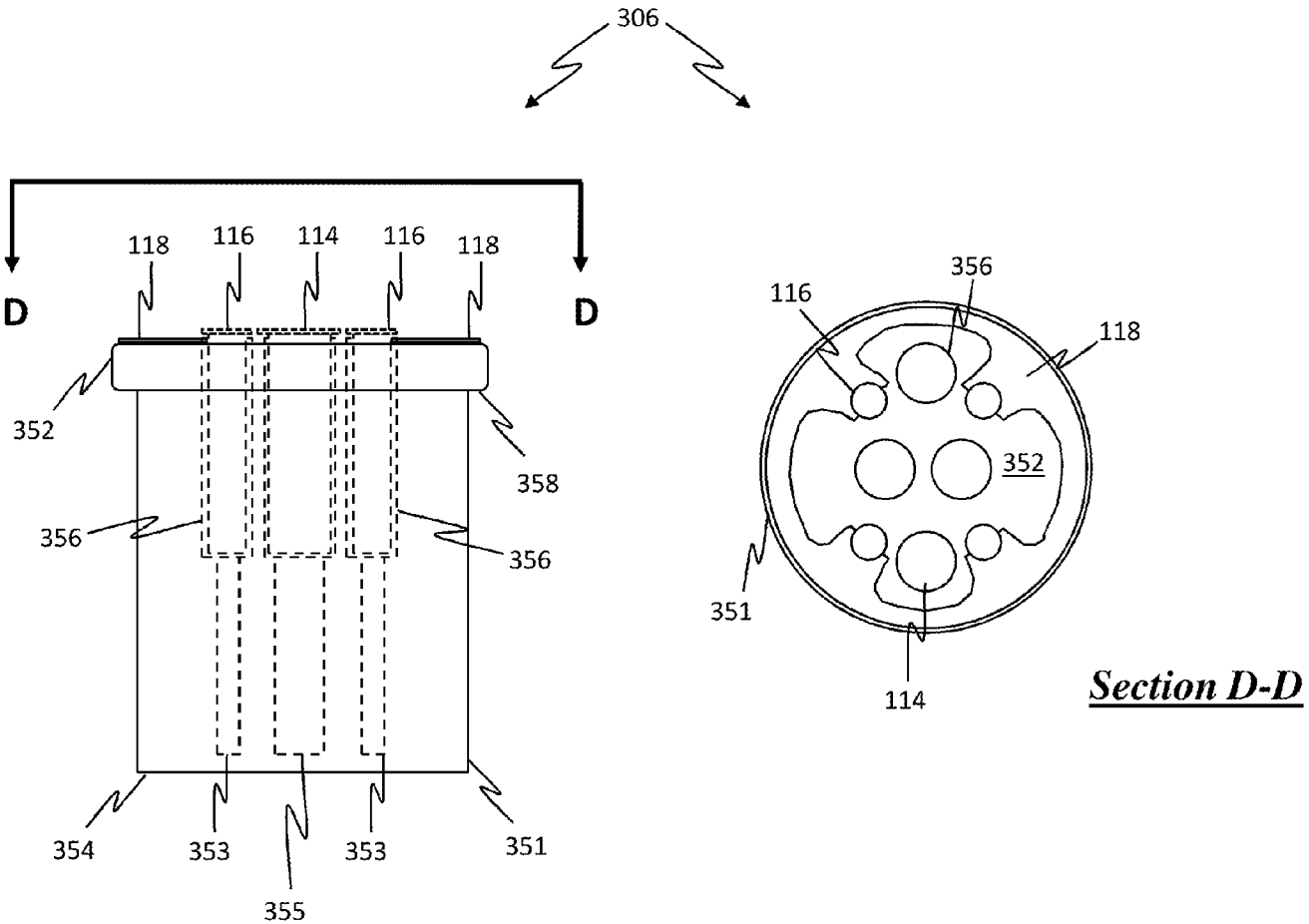
FIG. 6B is a side and top down view of a male contact insert for the Class L connector of FIG. 2A, in accordance with one embodiment of the present invention.

Referring to FIG. 6A, one embodiment of a contact insert 106 is shown in accordance with the present invention and includes an insert body 150 having an insert front 154 and an insert rear 152, wherein the insert body 150 is configured as a female connector. The insert body 150 has a plurality of socket channels 156 that are configured to securely contain power contact carriers 114 and/or ground contact carriers 116, wherein the insert front 152 of the insert body 150 is configured as a female connector. The ground plane 118 is shown on the surface of the insert rear 152 and is conductively connected to ground contact carriers 116. Referring to FIG.

6B, another embodiment of a contact insert 306 is shown in accordance with the present invention and is configured as a male connector. In this embodiment, the insert body 351 also has a plurality of socket channels 356 that are configured to securely contain power contact carriers 114 and/or ground contact carriers 116, and the insert front 354 of the insert body 351 is configured as a male connector having one or more grounding plugs 353 and/or power/signal plugs 355.

It should be appreciated that in one embodiment, the insert rear 152, 352 has a greater diameter than the insert front 154, 354 such that a lip 158, 358 is formed. The contact insert 106, 306 is placed into the connector shell cavity 104 of connector shell 102 by inserting the contact insert 106, 306 into the opening of the connector shell 102 proximate the base end 110 to be located within the connector shell cavity 104 such that the insert front 154, 354 is proximate the nose end 108 and the insert rear 152, 352 is proximate the base end 110. The internal surface of the connector shell 102 has a rim (or protruding surface) and is configured such that when the contact insert 106, 306 is located within the connector shell 102, the lip 158, 358 of the insert body 150, 351 contacts the rim and is prevented from passing through the connector shell 102 and exiting out of the opening of the connector shell 102 proximate the nose end 108.

The insert rear 152, 352 includes a conductive ground plane 118 located on the surface of the insert rear 152, 352 where the ground plane 118 is conductively attached to the ground contact carriers 116. In accordance with the invention, the ground plane 118 may be conductively attached to the ground contact carriers 116 via any method suitable to the desired end purpose, such as soldering the ground plane 118 to the ground contact carriers 116. In still yet other embodiments, the ground plane 118 may be conductively attached to the ground contact carriers 116 via a mechanical connection (such as a clip or mounting screw) or the ground contact carriers 116 may be integrated with the ground plane 118 as one piece of conductive material.

It should be appreciated that the ground plane 118, ground contact carriers 116, bonding nut 130 and connector shell 102 are constructed from an electrically conductive material, such as a metallic material. This configuration advantageously allows for ground continuity when the electrical connector is assembled.

Figure 7:
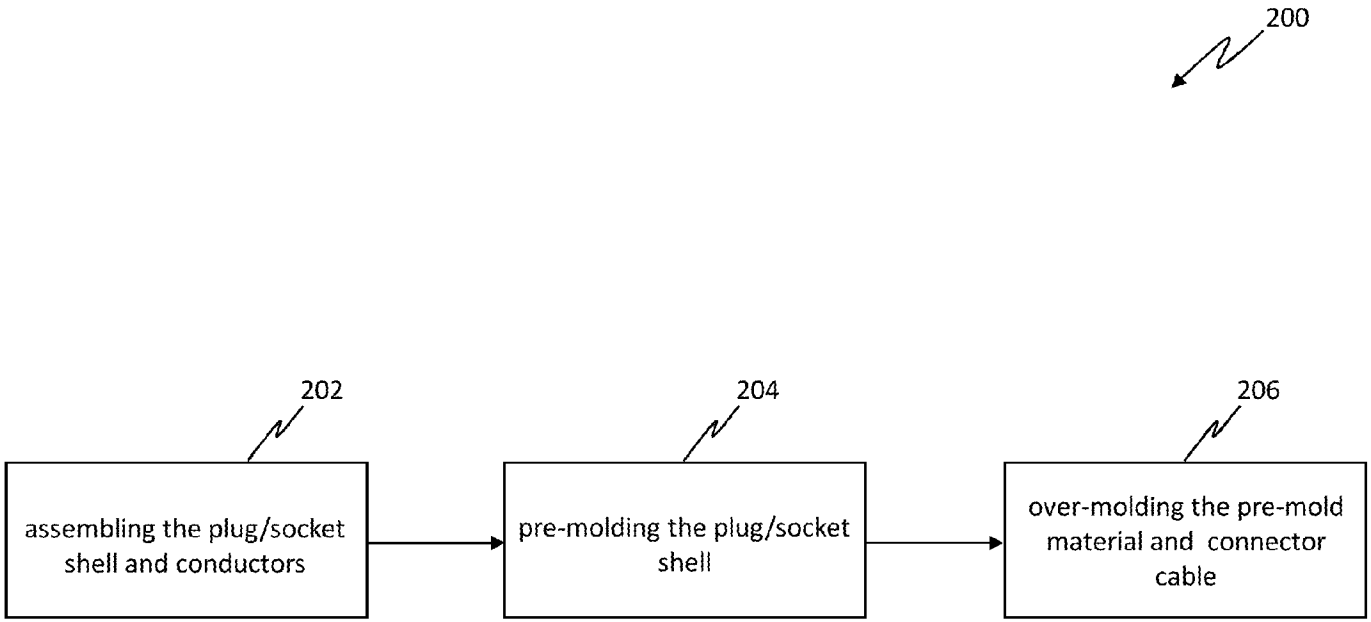
FIG. 7 is an operational block diagram illustrating a method for manufacturing the Class L connector of FIG. 2A and FIG. 2B, in accordance with one embodiment of the present invention.

Referring to FIG. 7, an operational block diagram 200 illustrating the overall process for assembling the electrical connector 100 is shown and includes configuring the connector shell 102 as described herein above, as shown in operational block 202. In accordance with one embodiment, the connector shell 102 may be assembled by inserting the contact insert 106, 306 into the connector shell cavity 104 such that the lip 158, 358 of the contact insert 106, 306 is resting on the rim or protruding surface located on the inner surface of the connector shell 102. It should be appreciated that the insert front 154, 354 is proximate the nose end 108 of the connector shell 102 and the insert rear 152, 352 is proximate the base end 110 of the connector shell 102. It should also be appreciated that the contact insert 106, 306 and the connector shell 102 are configured such that when the contact insert 106, 306 is contained within the connector shell cavity 104, a plug/socket shell cavity 109 exists proximate the base end 110 of the connector shell 102. The bonding nut 130 is associated with the base end 110 of the connector shell 102 by inserting the bonding nut 130 into the connector shell cavity 104 and rotating the bonding nut 130 to cause the bonding nut threaded surface 132 to engage with the plug/socket shell threaded inner surface 124 such that the bonding nut 130 is tightened against the ground plane 118. Is this way a ground continuity exists between the connector shell 102, the ground plane 118, the bonding nut 130, the at least one ground contact carrier 116 and the ground conductor that is located in the at least one ground contact carrier 116. Once the contact carrier 106 is assembled in the connector shell 102, the conductors (ground and/or power/signal conductors) of a cable can be securely and conductively attached to their respective contact carrier 114, 116, via any method suitable to the desired end purpose, such as by soldering, or by snap/friction fit. It should be appreciated that the connector shell 102 may be configured as a female shell or a male shell as discussed hereinbefore.

Figure 8:
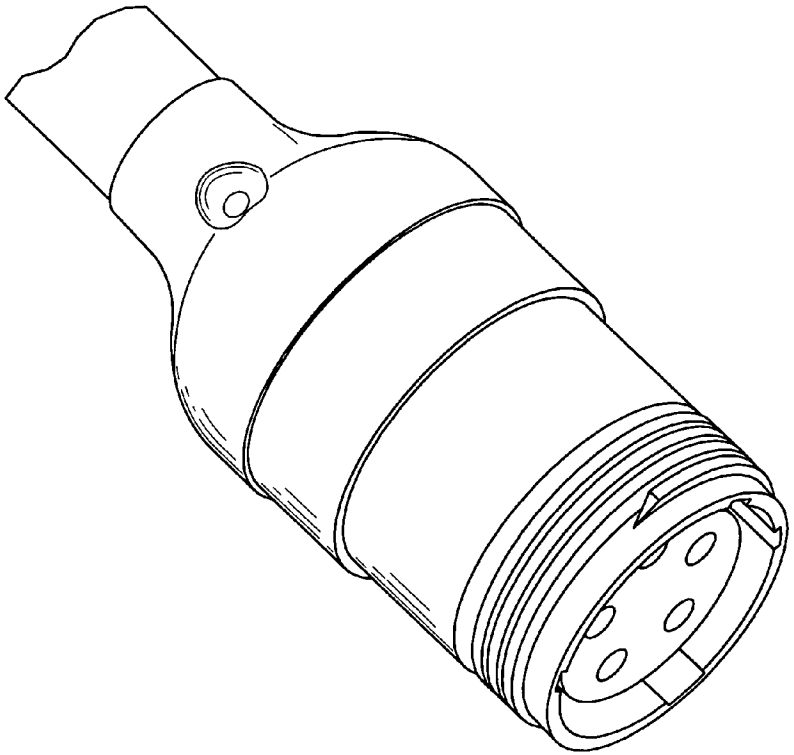
FIG. 8 is front side perspective isometric view of the Class L connector shell of FIG. 2B with the pre-mold material.
Figure 9:
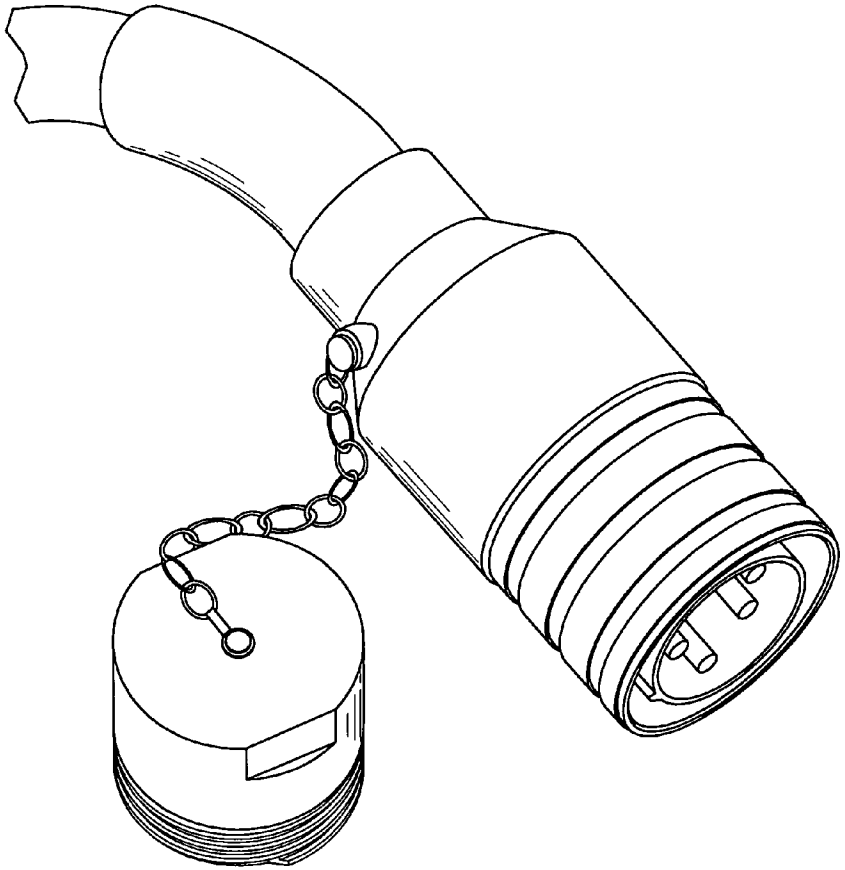
FIG. 9 is front side perspective isometric view of the Class L connector shell of FIG. 2A with the over-mold material and a dust cap.

Referring to FIG. 8, a pre-mold material (preferably polypropylene, however any other material suitable to the desired end purpose may be used) may be introduced to the assembly via injection (or any other suitable method) to cover and/or encapsulate a portion of the base end 110 of the connector shell 102, wherein the pre-mold material completely fills the plug/socket shell cavity 109 as well as covering the base end of the connector shell 102, the conductor connections to the power and ground carriers 114, 116 and a portion of the cable, as shown in operational block 204. It should be appreciated that the pre-mold material not only fills the plug/socket shell cavity 109 to encapsulate the connections between that conductors and pins/sockets, but it also covers and fills in the knurls/grooves 128 on the outer surface of the plug/socket shell portion 112. This advantageously prevents/limits longitudinal movement of the pre-mold material along the length of the outer surface 126 and/or rotational movement around the circumference of the outer surface 126. Referring to FIG. 9, an over-mold material (preferably Santoprene®, however any other material suitable to the desired end purpose may be used) is over-molded over the pre-mold material, as shown in operational block 206, where the over-mold material also covers at least a portion of the associated cabling. This over-mold configuration advantageously acts an effective strain relief as discussed hereinafter. If desired, a mounting article (such as a threaded insert, or a hex nut) may be molded into the over-mold and/or pre-mold material to secure a dust cap to the shell.

It should be appreciated that the present invention can be used with other types of cabling and is not limited to Class L connectors. Additionally, it should be further appreciated that the present invention may be accomplished using any method or device suitable to the desired end purpose. For example, the invention may use some or all of the characteristics and/or techniques as disclosed in U.S. patent application Ser. No. 12/856,220, filed on Aug. 13, 2010 and entitled "An Electrical Connector and A Method for Manufacturing Same," the contents of which are incorporated herein by reference in its entirety.

Accordingly, the electrical connector 100 of the present invention may be configured with any size shell (for example, may be configured with different shell sizes ranging from 28 to 52) and may be configured to operate with conductor sizes that range from size 6 AWG to 4/0 AWG (greater or smaller) and may be used to operate with electrical currents ranging from 40 to 200 amperes (greater or smaller). Additionally, the method of the invention as disclosed herein may be used with other embodiments and thus may be used with any size or type of connector and is thus, not limited to the embodiment disclosed herein.

It should be appreciated that the pre-mold material provides a mechanical bond between the cable and connector, fully encapsulates conductors and wiring terminals to provide strain relief and secure wire terminations, insulates conductors and terminals to eliminate shorting between conductors and provides environmental sealing of the terminations to prevent infiltration of contaminants and also eliminates pushed pins because the pre-mold material fills the terminal housing, capturing the contacts and preventing them from being pushed back into the connector housing. Furthermore, although the over-mold material is preferably constructed from a thermoplastic vulcanizate (TPV) (such as, but not limited to Santoprene® TPV) or thermoplastic elastomer (TPE) material, it is contemplated that the over-mold material may be any type of material that is flexible, absorbs impact and that protects the internal conductors while also providing resistance to a wide variety of chemicals (some materials for example may include thermoplastic polymers (i.e. polyethylene, polypropylene), styrenic block copolymers, polyolefin blends, elasatomeric alloys, thermoplastic polyurethanes, thermoplastic copolyester, thermoplastic ployamides, etc.). And because the over-mold material covers a portion of the associated cabling, the over-mold material also advantageously provides a flexible strain relief that improves the flex life of the cable and prevents premature wear and damage to the cable jacket. Accordingly, over-mold material advantageously assists the electrical connector 100 in having an ergonomic design which provides a firm gripping surface for mating and safe handling of connectors and allows for an optional custom molded logo insert to provide a customer's logo/identification on the connector. Moreover, the over-mold allows for molded-in arrows on the connector to assist with the correct alignment for easy mating and molded-in connector information for easy reference and identification.

Figure 10:
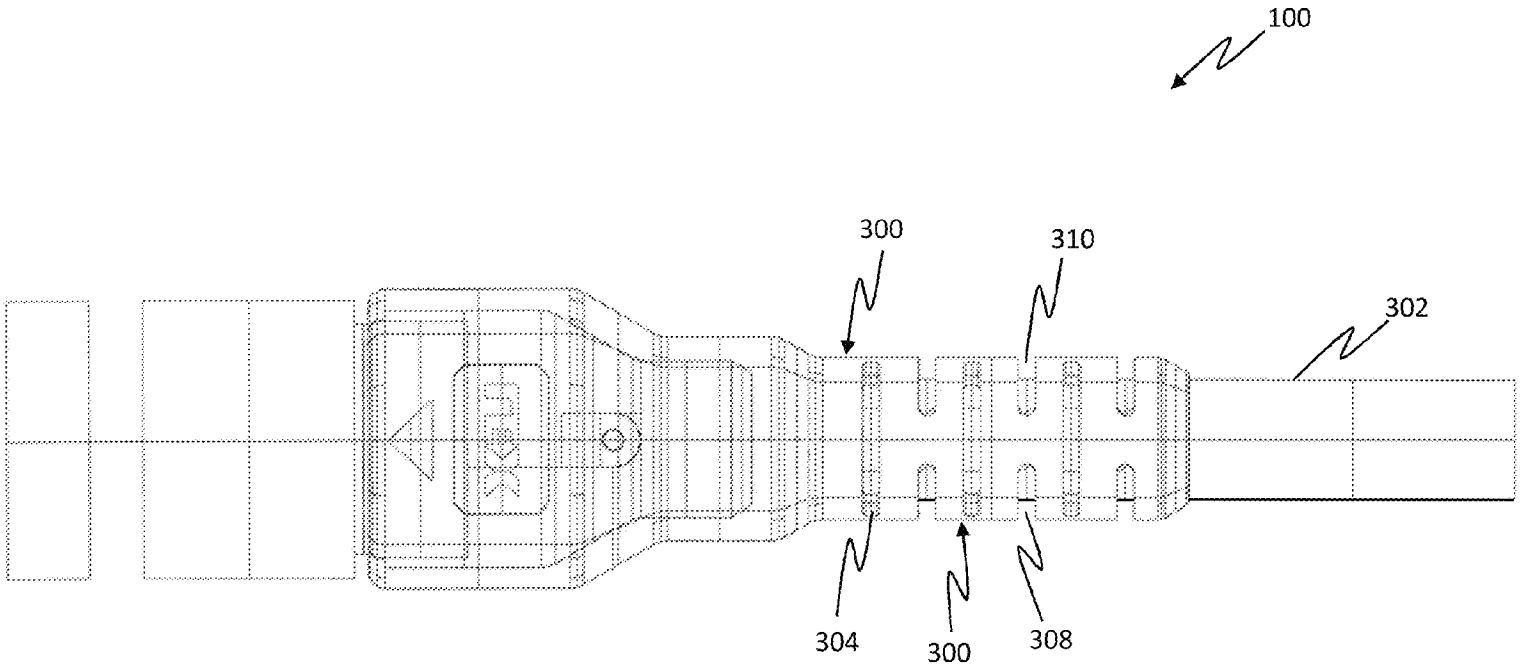
FIG. 10 is side view of the Class L connector shell of FIG. 2A showing one embodiment of a strain relief, in accordance with an exemplary embodiment of the invention.
Figure 11A:
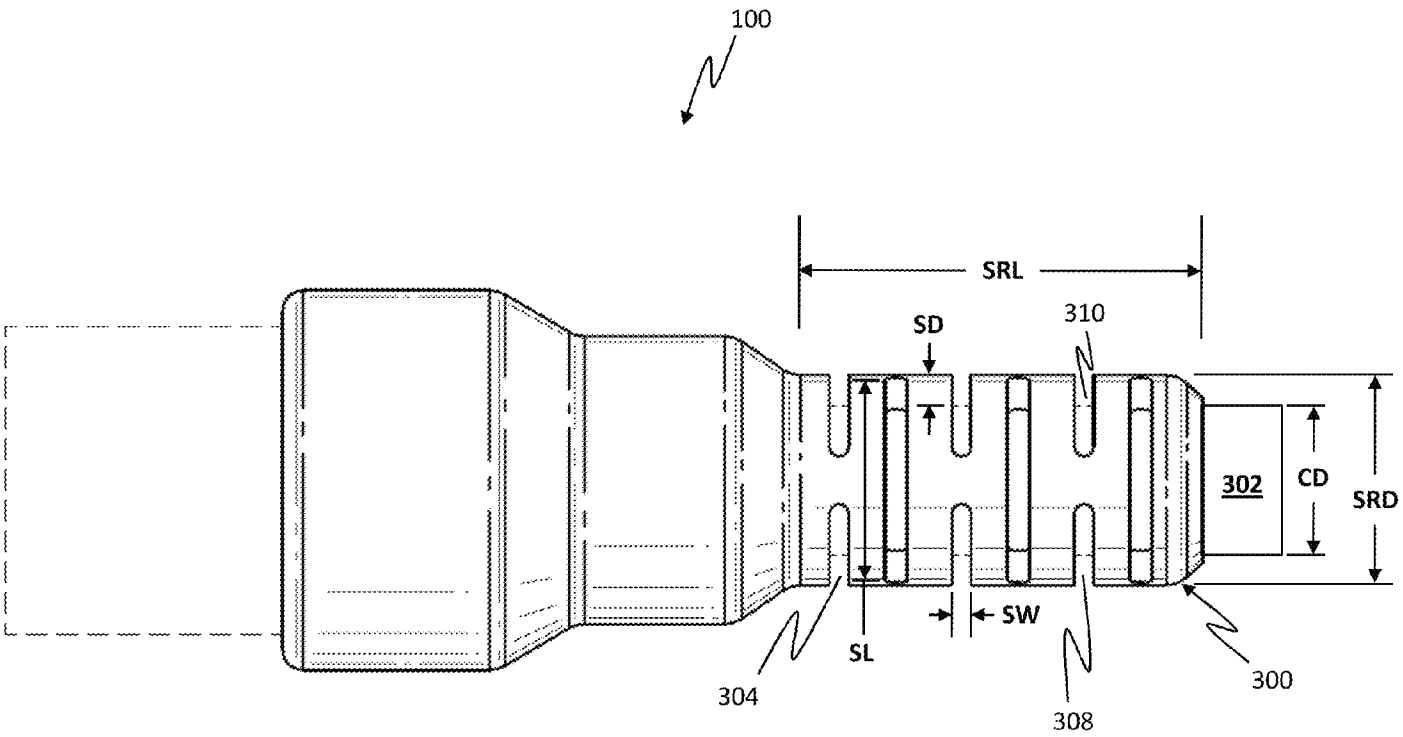
FIG. 11A side view of the Class L connector of FIG. 10 showing a closer view of the strain relief.

Referring to FIG. 10 and FIG. 11A, the electrical connector 100 includes an improved strain relief 300, in accordance with an exemplary embodiment of the invention. The strain relief 300 is formed by the over-mold material and has a strain relief diameter SRD and a strain relief length SRL, where the SRL covers all or a portion of the pre-mold material and a portion of the cable 302, wherein the cable 302 includes a cable diameter CD. It should be appreciated that the strain relief length (SRL) is preferably about 45% to 50% of the minimum bend radius (MBR) of the cable 302, where the MBR of the cable 302 may be determined as discussed further hereinafter or via any other method suitable to the desired end purpose. However, it is contemplated that the strain relief length (SRL) may range from about 30% to about 60% of the minimum bend radius (MBR) of the cable 302.

The strain relief 300 includes a plurality of slots 304 distributed along the length of the strain relief 300 and partially around the circumference of the strain relief. The plurality of slots 304 are configured in slot pairs having a first slot 308 and a second slot 310 and are located such that for each slot 308, 310 located along the length of the strain relief 300, there is a corresponding slot 310, 308 located on the opposing side of the strain relief 300. It should be appreciated that each of the slots 308, 310 are configured to extend partially along the circumference of the strain relief 300 to be separated from the slot 310, 308 on the opposing side of the strain relief by a body portion 312 of the strain relief 300. Furthermore, each of the slot pairs 308, 310 along the length of the strain relief 300 is offset from the adjacent slot pair 308, 310 along the circumference of the strain relief 300 by 90°. It should be appreciated that the slot pairs 308, 310 may be distributed equally along the length of the strain relief 300 or they may be distributed along the length of the strain relief 300 to focus on desired stress points (for example, near the beginning/ends of the strain relief 300). Moreover, each of the slots 308, 310 include a slot width SW, a slot length SL and a slot depth SD, wherein the slot width SW ranges from about 1/10 to 1/25 of the length of the strain relief 300 and the slot length is approximately equal to the diameter of the strain relief. It should be appreciated that the strain relief diameter (SRD) is approximately equal to 1.2 to 1.5 times the cable diameter CD, as desired. Thus, an approximate size of the strain relief diameter SRD can be expressed as:

$$SRD=CD*(1.35\pm0.15).$$

Moreover, because in an exemplary embodiment the slots 304 have a slot depth SD down to the jacket of the cable, it follows that an approximate size of the slot depth SD can be expressed as:

$$SD=(SRD-CD)/2\pm0.25.$$

It should be appreciated as the cable 302 is bent, relative to the electrical connector 100, the strain relief 300 advantageously works to distribute and limit the strain on the connection between the cable 302 and the connector 100. Another advantage is that because the strain relief 300 is constructed from the over-mold material, it resists harsh and environments and there are no metal shards or wires to break and cause injury to cable handlers like the Kellems grip. This is because as the cable 302 is being bent, the slots 304 on the side of the strain relief 300 in the direction of the bend are being compressed so that eventually a portion of the slot sides will contact each other. Simultaneously, the slots 304 on the side of the strain relief 300 in the opposing direction of the bend are being stretched so that the sides of the slots are pulled away from each other. Thus, the bending forces are being directed to the outer corners of the slots on the side in the direction of the bend and to the inner corners (i.e. near the cable) of the slots on the side in the direction opposite of the bend.

Figure 11B:
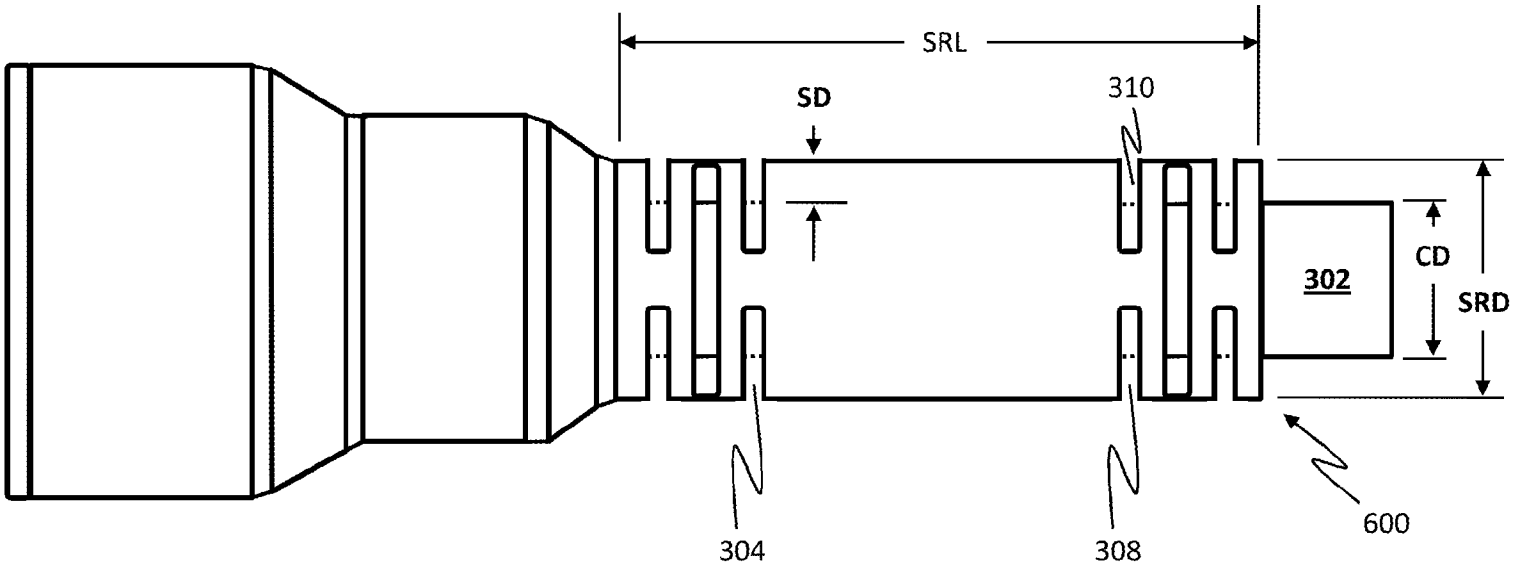
FIG. 11B is side view of the connector shell of FIG. 10 showing another embodiment of a strain relief.

Referring to FIG. 11B, another embodiment of the strain relief 600 is shown where the slots are arranged to be proximate the ends of the strain relief. This embodiment may be more advantageous in applications where the cable is more likely to the bent closer to the connector, such as that used with power cords for standard appliances or Ethernet cables.

Regarding the determination of the minimum bend radius (MBR) of the cable 302, the MBR may be determined by referring to acceptable standards (e.g. National Electrical Code (NEC) articles 300-34, 334-11 and 336-16) or the Insulated Cable Engineers Association (ICEA)) or the MBR may be determined via calculation (for example, MBR=6*D, where D is the diameter of the cable 302). It should be appreciated that the minimum bend radius may also be dependent upon the specific cable being used.

Figure 13:
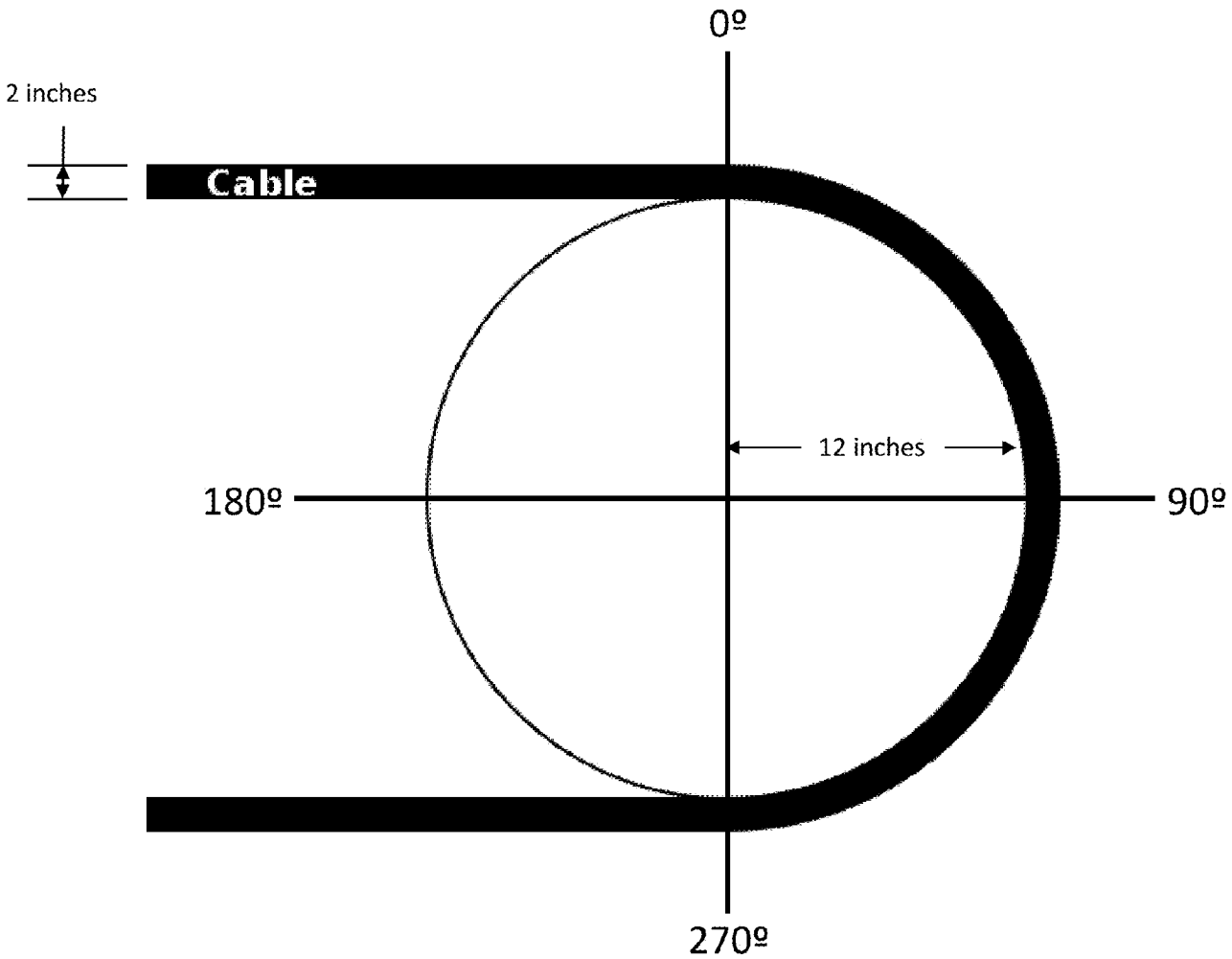
FIG. 13 is a side view showing a portable conductor cable 320 being bent around a radius of 12 inches.

It is known that the minimum bend radius (MBR) is usually expressed as multiples of the wire diameter and is typically measured relative to the inside curvature of the cable or wire that is being bent. The MBR typically refers to the approximate limit that a cable 302 can be bent without kinking it, damaging it or shortening its life. Thus, it stands to reason that the smaller the MBR, the more flexible the cable 302. Referring to FIG. 12 a table illustrating a simplified version of actual, more detailed, industry MBR recommendations for different cable types is shown. Referring to FIG. 13, a portable conductor cable 320 is shown being bent around a radius of 12 inches. If we assume that the cable 320 is at its MBR, then we can determined from the table in FIG. 12, that the overall diameter of the cable 320 is about 2 inches. For more precise technical information regarding minimum bend radius' reference can be made to NEC Articles 300-34, 334-11, and 336-16 as well as Appendix H of ICEA S-66-524 and ICEA 5-68-516. Additionally, other reference standards may also apply depending upon the technological filed, such as the International Telecommunications Union ITU-T G.651, ITU-T G.652 standards that govern the characteristics of a 50/125 μm multimode graded index optical fiber cable and characteristics of a single-mode optical fiber cable, respectively. It should be appreciated that observing the MBR of a cable is essential to the lifespan, safety and proper operation of the cable and an adequate strain relief is necessary to protect that cable. For example, if a fiber optic cable exceeds its MBR, the cable could break or the light being propagated within the cable may not be able to traverse the bend in the cable and thus, cease to function properly, if at all.

It should be appreciated that the slot width SW, the slot length SL and/or the slot depth SD may be chosen to give the strain relief more or less support and pliability as desired or based on application and/or to enhance the tactile feel of the electrical connector 100. It should also be appreciated that the novel and unique configuration of the slots of the strain relief 300, 600 provide superior strain relief protection, while helping to provide for an electrical connector that is more aesthetically pleasing, user friendly (with a more pleasant and easy to use feel), durable, electrically insulated, and flexible. It should also be appreciated that although as described herein, the slot depth SD is shown as going down to the cable jacket, it is contemplated that slot depths SD that do not go all the way down to the cable jacket may also be used. For example, a slot depth SD that only goes half way to the cable jacket provides for a strain relief that does not bend as easy and thus, provides more protection and a more rigid feel. As such, the slot depth SD may be chosen as desired (such as for greater/lesser flexibility and/or relief). This may be desirable for cables assemblies having smaller diameters and that are subject to more applications that include repeated bending and unbending.

Figure 14:
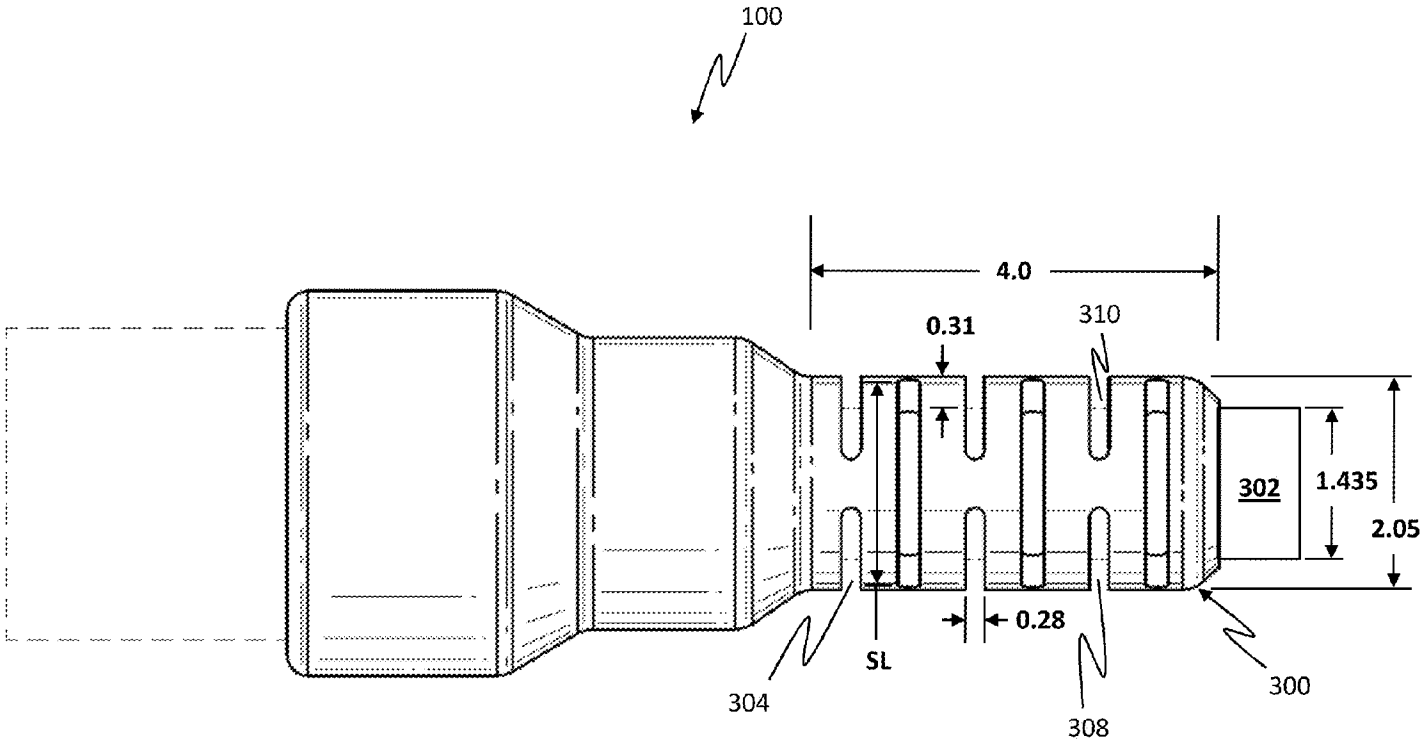
FIG. 14 is a side view of the Class L connector of FIG. 10 configured for use with a 100 Amp current application.

Referring to FIG. 14, one example of an electrical connector (female type) having a strain relief 300, in accordance with an exemplary embodiment is illustrated, where the connector is attached to a portable cable 302 and is configured for use with 100 Amp applications. As shown, the cable 302 includes a cable diameter CD of about 1.435 inches, while the strain relief 300 includes a SRL of about 4 inches, a SRD of about 2.05 inches and a plurality of slots 304 which are evenly distributed along the length of the strain relief 300. In accordance with the present invention, each of the slots 304 include a slot width SW of about 0.28 inches and a slot depth SD of about 0.31 inches. Accordingly, referring to the table in FIG. 11B, the minimum bend radius for this cable is about 8.61 (i.e. MBR=6×1.435).

Figure 15:
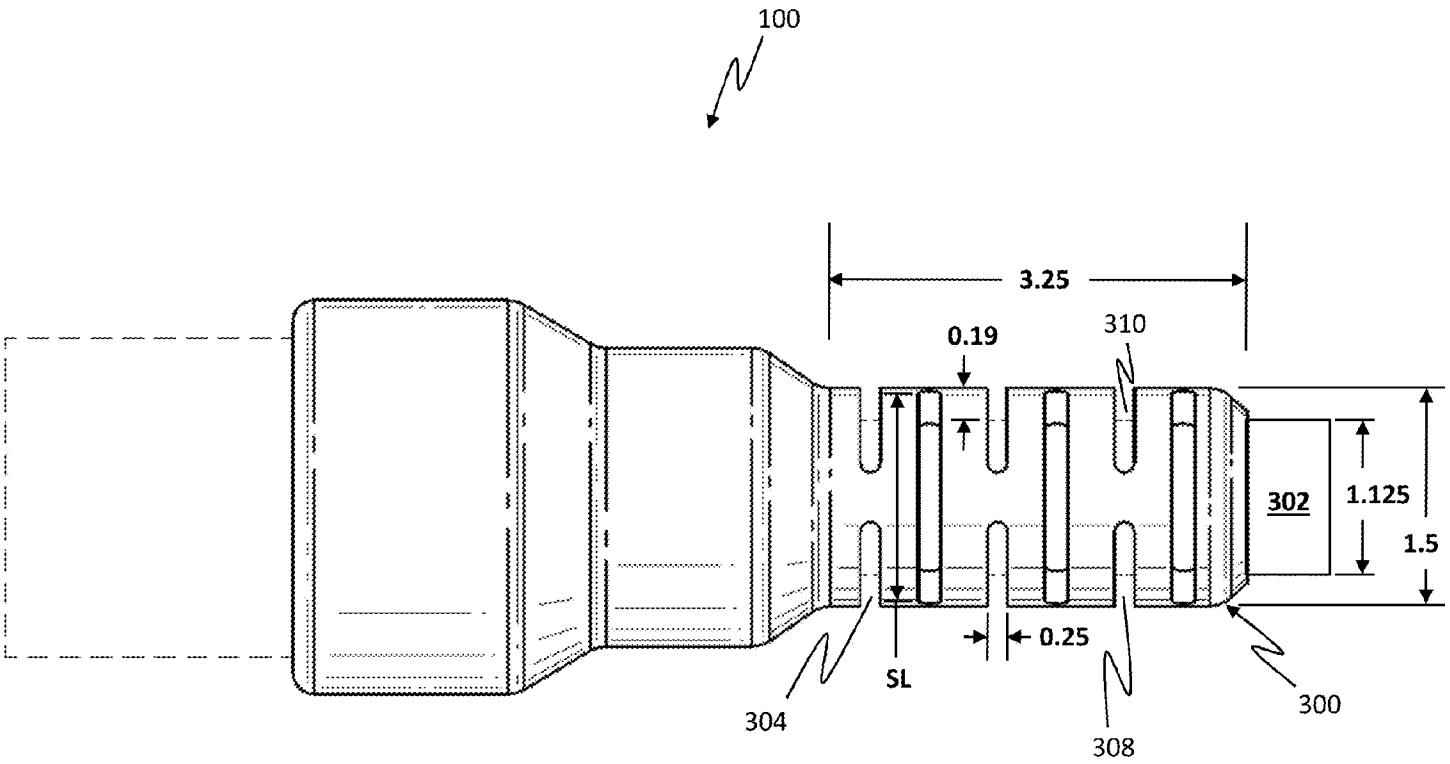
FIG. 15 is a side view of the Class L connector of FIG. 10 configured for use with a 60 Amp current application.

Referring to FIG. 15, another example of an electrical connector (male type) having a strain relief 300, in accordance with an exemplary embodiment is illustrated, where the connector is attached to a portable cable 302 and is configured for use with 60 Amp applications. As shown, the cable 302 includes a cable diameter CD of about 1.125 inches, while the strain relief 300 includes a SRL of about 3.25 inches, a SRD of about 1.5 inches and a plurality of slots 304 which are evenly distributed along the length of the strain relief 300. In accordance with the present invention, each of the slots 304 include a slot width SW of about 0.25 inches and a slot depth SD of about 0.19 inches. Accordingly, referring to the table in FIG. 12, the minimum bend radius (MBR) for this cable is about 6.75 (i.e. MBR=6×1.125).

Furthermore, it should be appreciated that the electrical connector of the present invention (male and female) are fully qualified to MIL-DTL-22992 standards with the following tests: Di-electric Voltage Withstand, Insulation Resistance Test, Submersion Test, Drop Test and Cable Pull Force. Accordingly, the connector in accordance with the present invention maintains the required conductive coating and continuity from shell to ground per MIL-DTL-22992 as well as Environmental Rating—Watertight per MIL-DTL-22992.

It should be appreciated that the present invention may be used for any field of technology that employs cables and also may include other embodiments that are also applicable in any field of technology that employs cables. For example, the present invention may be used for connectors prevalent in the fiber optic, medical, industrial, geological and/or the entertainment fields. Furthermore, it should be appreciated that the sizes and dimensions as disclosed herein are given in inches and are not meant to be limiting. Rather the invention is meant to include various other sizes and units as desired and as suitable to the desired end purpose.

Moreover, it should be appreciated that each of the elements of the present invention may be implemented in part, or in whole, in any order suitable to the desired end purpose. In accordance with an exemplary embodiment, the processing required to practice the method of the present invention, either in whole or in part, may be implemented, wholly or partially, by a controller operating in response to a machine-readable computer program. In order to perform the prescribed functions and desired processing, as well as the computations therefore (e.g. execution control algorithm(s), the control processes prescribed herein, and the like), the controller may include, but not be limited to, a processor(s), computer(s), memory, storage, register(s), timing, interrupt (s), communication interface(s), and input/output signal interface(s), as well as combination comprising at least one of the foregoing. It should also be appreciated that the embodiments disclosed herein are for illustrative purposes only and include only some of the possible embodiments contemplated by the present invention.

While the invention has been described with reference to an exemplary embodiment, it should be understood by those skilled in the art that various changes may be made and equivalents may be substituted for elements thereof without departing from the scope of the invention. In addition, many modifications may be made to adapt a particular situation or material to the teachings of the invention without departing from the scope thereof. Therefore, it is intended that the invention not be limited to the particular embodiment disclosed as the best mode contemplated for carrying out this invention, but that the invention will include all embodiments falling within the scope of the appended claims. Moreover, unless specifically stated any use of the terms first, second, etc. do not denote any order or importance, but rather the terms first, second, etc. are used to distinguish one element from another.

What is claimed is:

1. An electrical connector, comprising:

a connector shell defining a connector shell cavity and having a connector nose end and a connector base end, wherein the connector shell includes a connector shell internal threaded portion proximate the connector base end;

a contact insert having a power contact carrier, a ground contact carrier and a ground plane, wherein the ground contact carrier is conductively connected to the ground plane; and a bonding nut having a bonding nut threaded portion, wherein the contact insert and bonding nut is contained within the connector shell cavity to be proximate the connector base end, such that the bonding nut threaded portion engages the connector shell internal threaded portion to contact the ground plane.

2. The electrical connector of claim 1, wherein when the connector nose end is configured to connect with a nose end of a compatible connector.

3. The electrical connector of claim 1, wherein the connector nose end is configured as either a male connector or a female connector, and wherein when the connector nose end is configured as a male connector, the connector nose end is configured to connectively couple with a compatible female connector, and when the connector nose end is configured as a female connector, the connector nose end is configured to connectively couple with a compatible male connector.

4. The electrical connector of claim 1, further comprising a cable having a power conductor and a ground conductor, wherein the power conductor is conductively connected to the power contact carrier and wherein the ground conductor is conductively connected to the ground contact carrier.

5. The electrical connector of claim 4, further comprising a pre-mold material which covers a portion of the contact insert, a portion of the connector base end and a portion of the cable.

6. The electrical connector of claim 5, wherein the connector shell includes a connector shell outer surface which includes a plurality of knurls/grooves and wherein the pre-mold material is configured to cover at least a portion of the knurls/grooves to limit as least one of longitudinal movement and rotational movement of the pre-mold material.

7. The electrical connector of claim 1, wherein the connector nose end is configured as either a male connector or a female connector, and wherein when the connector nose end is configured as a male connector, the connector nose end includes a coupling ring having a threaded portion for engaging with a threaded portion of a compatible female connector, and when the connector nose end is configured as a female connector, the connector nose end includes a nose end threaded portion for engaging with a coupling ring of a compatible male connector.

8. The electrical connector of claim 5, further comprising an over-mold material which covers the pre-mold material and a portion of the cable.

9. The electrical connector of claim 5, wherein the pre-mold material is polypropylene and the over-mold material is a thermoplastic vulcanizate (TPV) material.

10. An electrical connector assembly, comprising:

a contact insert, a connector shell and a bonding nut, wherein the contact insert includes an insert front, an insert rear, a ground contact carrier, a power contact carrier and a ground plane, and wherein the power contact carrier and ground contact carrier are conductively communicated with the insert front and the insert rear, and wherein the ground contact carrier is conductively connected to the ground plane, and wherein the insert front is configured to associate with a compatible electrical interface and the insert rear is configured to associate with a conductor of a cable; and wherein the connector shell is configured to contain at least a portion of the contact insert and includes a connector nose end and a connector base end, and wherein when the contact insert is contained within the connector shell, the insert rear is located relative to the connector base end such that when the conductor of the cable is associated with the insert rear, the conductor is at least partially located within the connector shell; and wherein when the contact insert is contained within the connector shell, the bonding nut is securely associated with the connector shell such that the connector shell, the ground plane, the ground contact carrier and the bonding nut are electrically and conductively connected.

11. The electrical connector of claim 10, wherein when the connector nose end is configured to couple with a nose end of a compatible connector.

12. The electrical connector of claim 10, wherein the connector nose end is configured as either a male connector or a female connector, and wherein when the connector nose end is configured as a male connector, the connector nose end is configured to connectively couple with a compatible female connector, and when the connector nose end is configured as a female connector, the connector nose end is configured to connectively couple with a compatible male connector.

13. The electrical connector of claim 10, wherein the cable further includes a power conductor, wherein the power conductor is conductively connected to the power contact carrier and wherein the ground conductor is conductively connected to the ground contact carrier.

14. The electrical connector of claim 10, further comprising a pre-mold material which covers a portion of the contact insert, a portion of the connector base end and a portion of the cable.

15. The electrical connector of claim 14, wherein the connector shell includes a connector shell outer surface which includes a plurality of knurls/grooves and wherein the pre-mold material is configured to cover at least a portion of the knurls/grooves to limit as least one of longitudinal movement and rotational movement of the pre-mold material.

16. The electrical connector of claim 14, further comprising an over-mold material which covers the pre-mold material and a portion of the cable.

17. The electrical connector of claim 16, wherein the pre-mold material is polypropylene and the over-mold material is a thermoplastic vulcanizate (TVP) material.

18. The electrical connector of claim 10, wherein the connector nose end is configured as either a male connector or a female connector, and wherein when the connector nose end is configured as a male connector, the connector nose end includes a coupling ring having a threaded portion for engaging with a threaded portion of a compatible female connector, and when the connector nose end is configured as a female connector, the connector nose end includes a nose end threaded portion for engaging with a coupling ring of a compatible male connector.

19. A method for assembling an electrical connector, wherein the electrical connector includes a connector shell defining a connector shell cavity and having a connector nose end, a connector base end and a connector shell internal threaded portion proximate the connector base end, a contact insert having a contact rear, a power contact carrier, a ground contact carrier and a ground plane, and a bonding nut having a bonding nut threaded portion, the method comprising:

inserting the contact connector into the connector shell cavity such that the contact rear is proximate the connector base end;

associating the bonding nut with the connector shell cavity such that the connector shell internal threaded portion and the bonding nut threaded portion engage each other whereby the bonding nut compresses the ground plane;

connecting a power conductor of a cable with the power contact carrier and a ground conductor of the cable with the ground contact carrier; and associating a pre-mold material with the connector base end of the electrical connector to cover a portion of the contact insert, a portion of the connector base end and a portion of the cable.

20. The method of claim 19, further comprising associating an over-mold material with the electrical connector to cover the pre-mold material and a portion of the cable.

* * * * *